US005684512A

United States Patent [19]

Schoch et al.

[11] Patent Number: 5,684,512

[45] Date of Patent: *Nov. 4, 1997

[54] ERGONOMIC APPARATUS FOR CONTROLLING VIDEO OR COMPUTER EQUIPMENT

[76] Inventors: Paul T. Schoch, 1002 Rainbow Crest Dr.; Marvin G. Schoch, 1001 Rainbow Crest Dr., both of Fallbrook, Calif. 92028

[ * ] Notice: The term of this patent shall not extend beyond the expiration date of Pat. No. 5,261,291.

[21] Appl. No.: 650,345

[22] Filed: May 20, 1996

[51] Int. Cl.[6] ..... G09G 5/08

[52] U.S. Cl. ..... 345/161; 345/168; 345/184

[58] Field of Search ..... 345/161, 168, 345/184

[56] References Cited

U.S. PATENT DOCUMENTS

| | | | |
|---|---|---|---|
| 4,748,441 | 5/1988 | Brzezinski . | |
| 4,820,162 | 4/1989 | Ross | 345/161 |
| 5,252,821 | 10/1993 | Sugimura . | |
| 5,261,291 | 11/1993 | Schoch et al. . | |
| 5,396,266 | 3/1995 | Brimhall | 345/161 |

*Primary Examiner*—Richard Hjerpe
*Assistant Examiner*—Juliana Kim
*Attorney, Agent, or Firm*—Drummond & Duckworth

[57] ABSTRACT

An apparatus is provided for ergonomically controlling video or computer functions or the like. A vertical control stick provides means for producing and transmitting signals to a computer. A first signal means is interconnected with the control stick such that movement of the stick forward from a neutral stick position causes a first set of signals to be transmitted to a computer. Similarly, a second signal means is interconnected with the stick such that movement of the control stick rearward from the neutral stick position causes a second set of signals to be transmitted to a computer. A rotatable collar is annularly disposed on the outer surface of the stick such that the collar may be manually rotated about the longitudinal axis of the stick in both clockwise and counterclockwise directions from a neutral collar position. Clockwise rotation of the collar away from the neutral collar position causes a third set of signals to be transmitted to a computer. Similarly, counterclockwise rotation of the collar away from the neutral collar position causes a fourth set of signals to be transmitted to a computer. A console is mounted on an upper end of the control stick. The console has a control panel with one or more controls for controlling video or computer functions. The controls are configured for finger actuation so that a single hand can provide manual control of the stick, the collar, and the control panel. Status indicators are further included on the console to provide status of video or computer functions.

5 Claims, 4 Drawing Sheets

ERGONOMIC APPARATUS FOR CONTROLLING VIDEO OR COMPUTER EQUIPMENT

BACKGROUND OF THE INVENTION

This invention relates generally to devices for controlling video or computer equipment or the like, and, more particularly, to a control stick for controlling multiple computer functions with one hand.

Single handed control devices for controlling computer operated equipment and computer functions are known in the prior art. Hand operated controls have many useful applications for controlling computer operated equipment and computer functions. These applications include the operation of video games, computer numeric controlled (CNC) equipment, information display, computer programs such as word processing and automated mapping, and many others too numerous to list.

The common terms for two such single handed control devices include computer "mouse" and computer "joystick". A mouse is a device including a housing and a spherical ball on its underside. In operation, the mouse's underside is placed against a hard surface such that movement imparted to the mouse causes the spherical ball to rotate. This rotation is translated into electrical signals which are then transmitted to a computer. Meanwhile, a typical joystick includes a shaft capable of inclination from the vertical axis. The shaft includes multiple electrical contacts which are configured to engage other contacts disposed in the joystick housing. By hand manipulation of the joystick shaft, the operator selectively causes the completion of different circuits which in turn transmits signals to the computer.

Additional control apparatus for controlling the functions of a computer include computer keyboards, touch pads, touch screens and many more. The many attempts to provide control apparatus evidence the ongoing need for a satisfactory device for controlling the functions of a computer.

Unfortunately, none of the prior art control devices allow a user to rotate a control member to provide to the computer a signal representative of rotation with the ability to control additional computer functions using a single hand. There are numerous applications where it would be advantageous to do just this. For example, numerous computer and video games require the user to simulate the rotation of a steering wheel. Often a joystick is operated such that hand manipulation of the shaft in a first direction is representative of a computer simulated steering wheel being rotated in the counterclockwise direction, while hand manipulation of the stick in a second direction is representative of a computer simulated steering wheel being rotated in the clockwise direction. Unfortunately, these devices do not permit a user to rotate a control member in similar fashion as the simulated steering wheel of the computer.

In the alternative, it is known to connect a second device to the computer to provide signals representative of rotation. To this end, there are numerous prior art devices available which are configured similarly to miniaturized steering wheels which are connected to a computer. Unfortunately, such devices make no provision for controlling additional computer functions therefrom which are most easily controlled by operation of a joystick. Further, though various attempts have been made to combine the attributes of different control apparatus into a single hand device, the present inventors know of no prior art devices that are ergonomically designed to combine the functional control advantages of a joystick and a device that allows the user to impart rotation on a single hand device.

For example, U.S. Pat. No. 4,748,441 issued to Brzezinski discloses a multiple function control member which includes a first joystick disposed on the upper extremity of a second joystick. Unfortunately, neither joystick is capable of transmitting signals to a computer or the like by rotation of a control member.

In addition, U.S. Pat. No. 5,261,291, which issued to the inventors of the present invention and is incorporated by reference herein, discloses a device including a rotatable collar and a shaft capable of inclination from the vertical axis. However, this device is disclosed as being utilized for the control of a vehicle. There is no suggestion or teaching that this device is capable of controlling video or computer equipment or the like.

Similarly, U.S. Pat. No. 5,252,821 issued to Sugimura discloses a control system for an ophthalmic apparatus including a rotary knob affixed to the shaft of a joystick. Again, there is no suggestion or teaching that this device is capable of controlling video or computer equipment or the like.

Accordingly, it is an object of the invention to provide for a single unit computer multiple function operational control system.

Another object of the present invention is to provide a single unit control system for controlling video or computer functions that permits rotation of a control member with the functional control advantages of a joystick.

These and other objects of the present invention will be understood by those in the art by referring to the following description in conjunction with the accompanying drawings.

SUMMARY OF THE INVENTION

The present invention is an ergonomic apparatus for controlling video or computer functions or the like. A vertical control stick provides means for producing and transmitting signals to a computer. The apparatus may include a pivotal attachment means or a slidable attachment means at the lower end of the stick for either pivotal attachment or slidable attachment of the stick to a fixed surface. In a preferred embodiment, the stick is restricted to movement to both forward and rearward of a neutral stick position. However, the terms forward and rearward are used herein for convenience, it being understood by those in the art that the device can be rotated for movement of the stick in the left and right directions.

A first signal means is interconnected with the stick such that movement of the stick forward from the neutral stick position causes a first set of signals to be transmitted to a computer. Similarly, a second signal means is interconnected with the stick such that movement of the stick rearward from the neutral stick position causes a second set of signals to be transmitted to a computer.

A rotatable collar is annularly disposed on the outer surface of the stick such that the collar may be manually rotated about the longitudinal axis of the stick in both clockwise and counterclockwise directions from a neutral collar position. Clockwise rotation of the collar away from the neutral collar position causes a third set of signals to be transmitted to a computer. Similarly, counterclockwise rotation of the collar away from the neutral collar position causes a fourth set of signals to be transmitted to a computer.

A console may be optionally mounted on an upper end of the stick. The console has a control panel with a plurality of control means for finger actuation so that a single hand can provide manual control of the stick, the collar, and the control panel. As would be understood by those in the art, the control panel may include any number of control means including switches, push buttons, rotatable knobs, etc. Furthermore, the console may include status indicators for providing status of computer functions. For example when operating computer numeric control (CNC) equipment the console may be equipped with indicators showing job status and the like.

The present invention combines numerous computer control functions on a single control handle which is ergonomically designed to allow easy manipulation of function controls with the same hand. Further, the present invention can be used with a combination of electrical, hydraulic, or mechanical linkages to various control actuators for accurate control of video and computer functions, thereby allowing flexibility in design. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
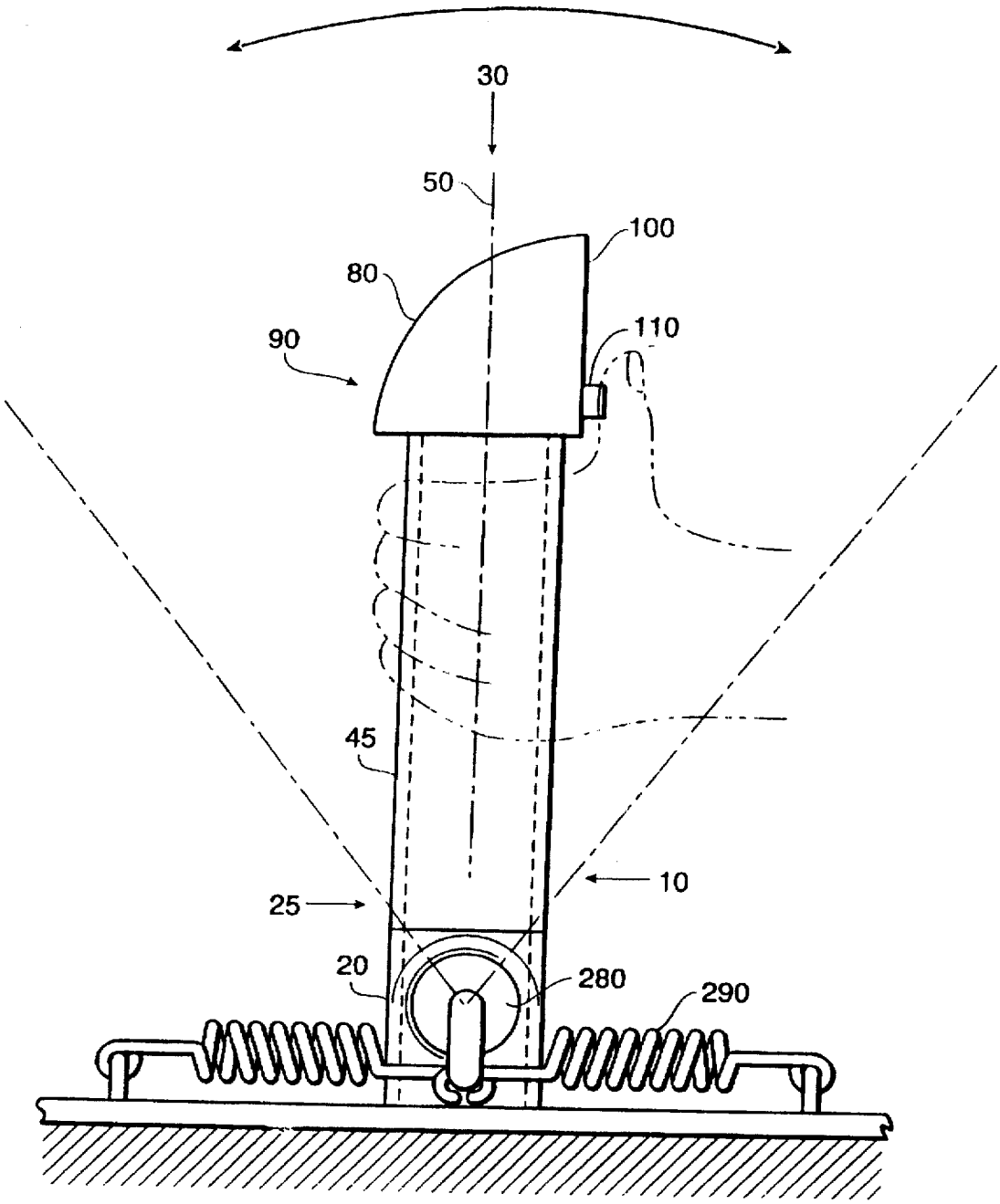
FIG. 1 is a right side elevational view of the invention, illustrating a hand in phantom outline grasping a control stick of the invention.
Figure 2:
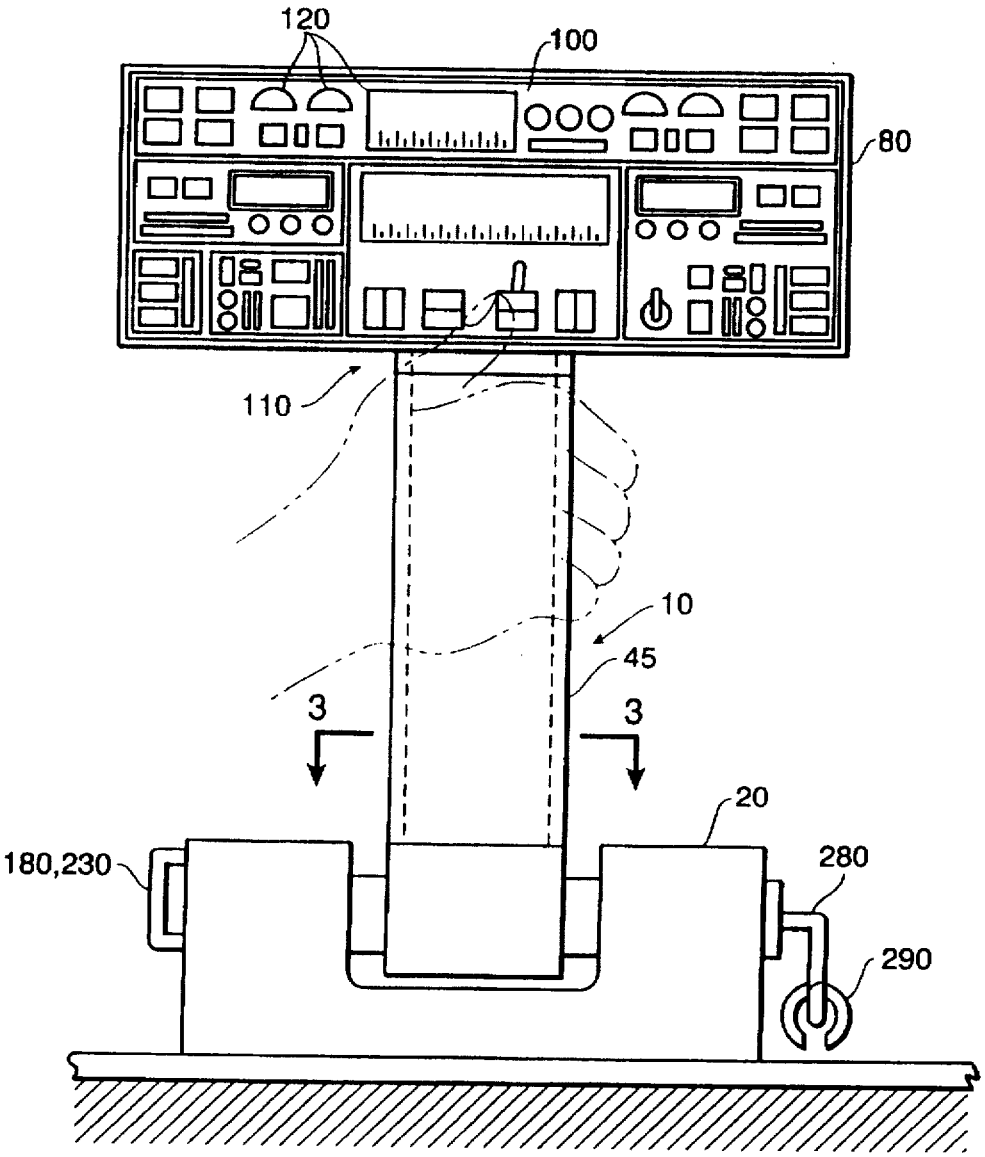
FIG. 2 is a front elevational view of the invention, illustrating the control stick of FIG. 1 and a control console located thereon.

FIGS. 1 and 2 show a simplified ergonomic apparatus for controlling video or computer functions. One embodiment of the invention includes a vertical control stick 10 and a housing 20 pivotally attached to the lower end 25 of the stick 10. The housing 20 may include at least one horizontally oriented pivot pin 280 for pivotal rotation of the stick 10. In a preferred embodiment, the stick 10 is restricted to movement along the line of direction of both forward and rearward, of a neutral stick position 30. The terms "forward" and "rearward" are used herein for convenience, it being understood by those in the art that the device can be rotated for movement of the stick in the left and right directions. Preferably, the apparatus further includes a first urging means 290 for urging the stick 10 towards the neutral stick position 30. The first urging means 290 may be a pair of springs, as illustrated in FIG. 1, or may be any other suitable urging means. The stick 10 is preferably manufactured from a rigid material, such as a plastic or metal alloy. Clearly, as would be understood by those in the art, stick 10 may also be manufactured from a combination of rigid and semi-rigid materials.

Figure 4:
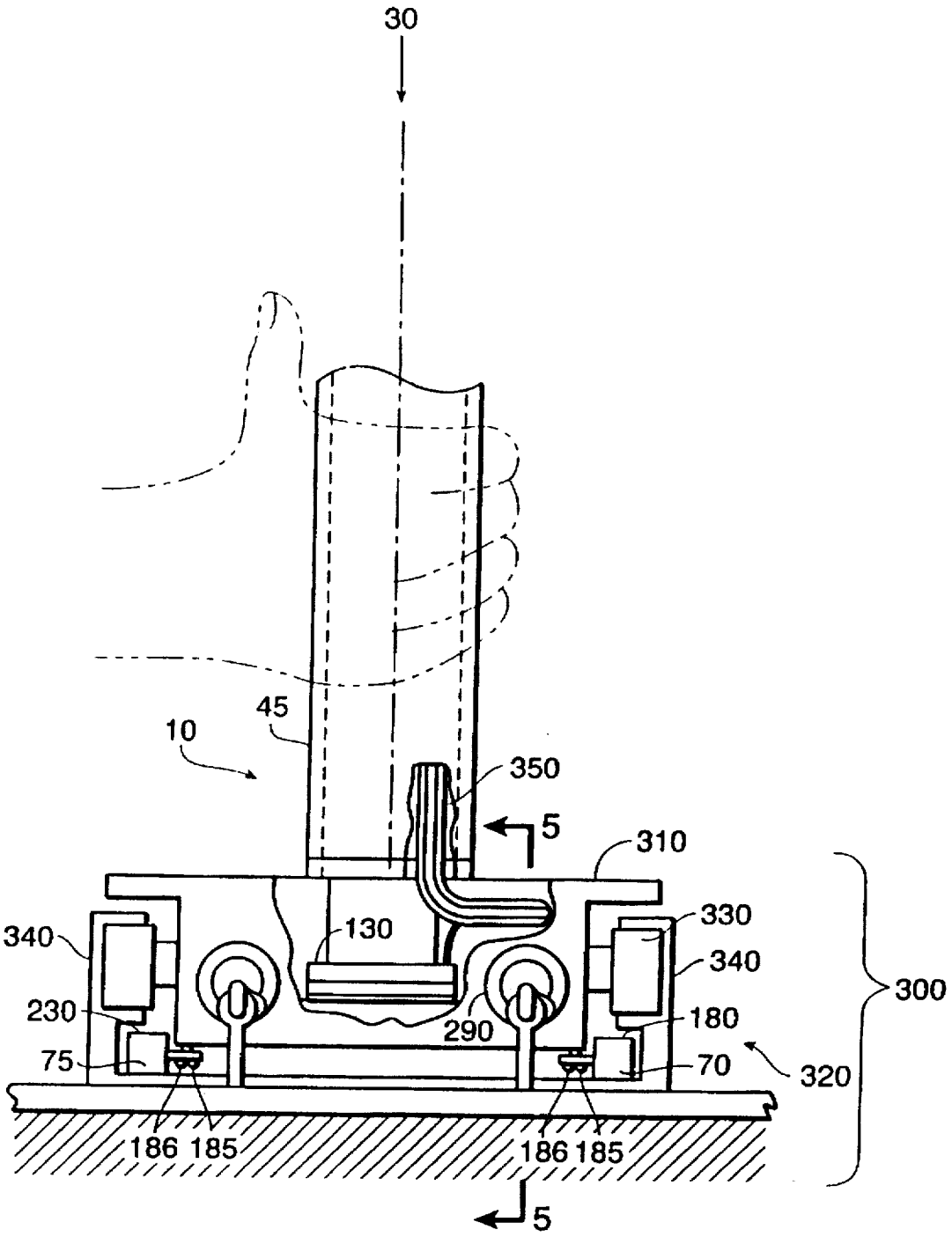
FIG. 4 is a front elevational view of an alternate embodiment of the invention, illustrating a slidable attachment means of the control stick, and a collar position sensor.
Figure 5:
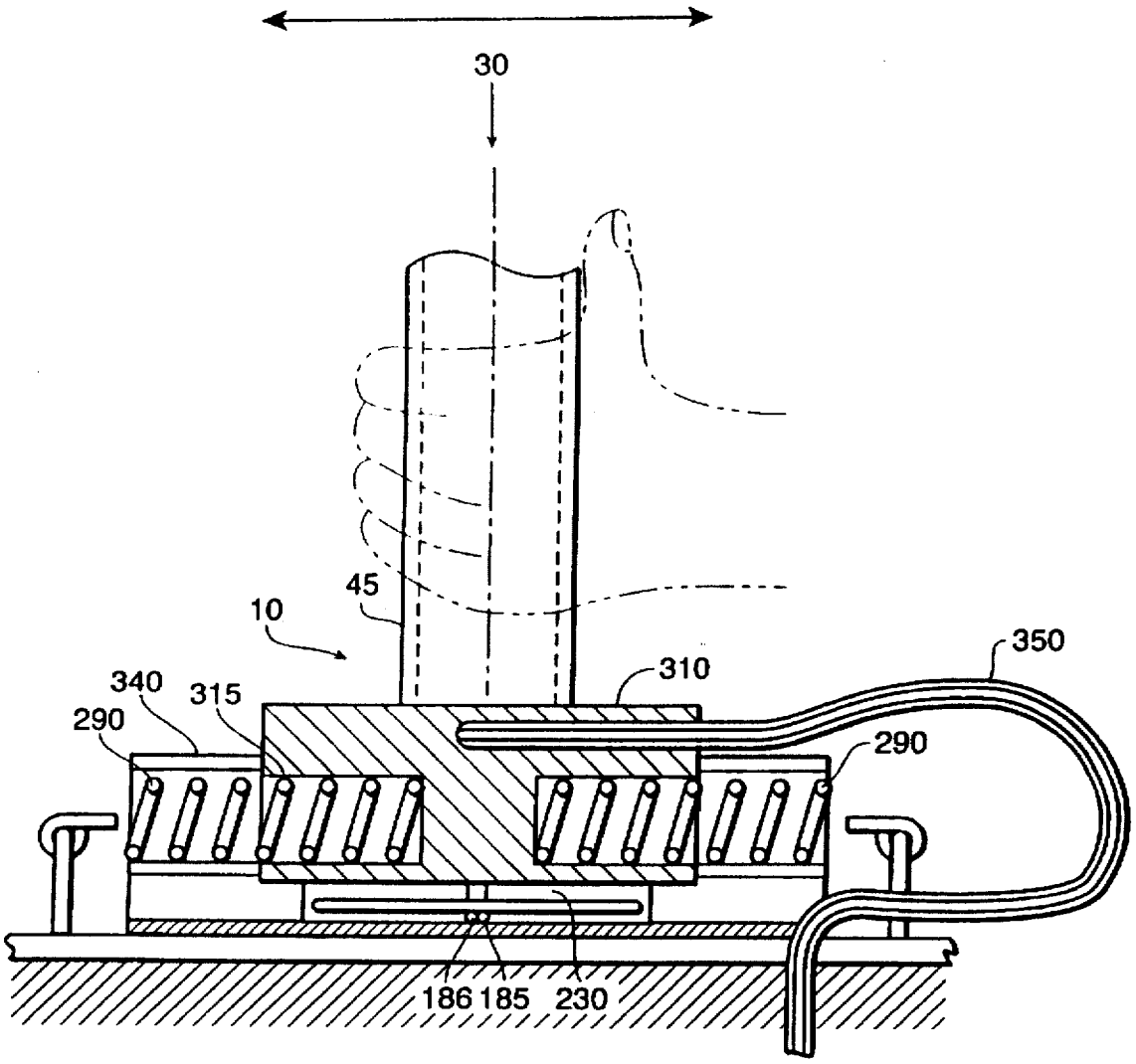
FIG. 5 is a cross sectional view of the invention, taken generally along lines 5—5 of FIG. 4, illustrating a first urging means for urging the control stick into a neutral control stick position.

In a preferred embodiment, illustrated in FIG. 4 and 5, the invention includes a slidable attachment means 300 for slidable attachment of the stick 10 to a fixed surface. Preferably, the slidable attachment means 300 includes a carrier assembly 310 fixed to the lower end of the stick 10, and a track assembly 320 fixed to the fixed surface. The carrier assembly 3 10 includes bearing means 330, fixed on opposing sides of the carrier assembly 310, that slidably engage a pair of opposing tracks 340 on the track assembly 320. A flexible conduit 350 is included, one end of which is attached to the carrier assembly 310 and the other end of which is attached to the fixed surface. The flexible conduit 350 allows the carrier assembly 310 to move freely along the track assembly 320, and may contain wires, control cables, and the like. The first urging means 290 of such an alternate embodiment may comprise two opposing pairs of springs, as illustrated in FIG. 5, and corresponding carrier cavities 315. Such an urging means 290 urges the stick 10 into the neutral stick position 30. Preferably, the slidable attachment means 300 is manufactured from a rigid material, with bearing means 330 and tracks 340 being of conventional type well known to those in the art.

The present invention further includes a first signal means 70 interconnected with the stick 10 such that movement of the stick 10 forward from the neutral stick position 30 causes a first set of signals to be transmitted to the computer (not shown), with the voltage being proportional to the magnitude of movement of the stick 10 away from the neutral stick position 30. Similarly, a second signal means 75 is interconnected with the stick 10 such that movement of the stick 10 rearward from the neutral stick position 30 causes a second set of signals to be transmitted to the computer, with the voltage being proportional to the magnitude of movement of the stick 10 away from the neutral stick position 30. Alternate embodiments of the invention might dictate that the voltage produced by the first and second signal means is non-linear with respect to the magnitude of movement of the stick 10 away from the neutral stick position 30.

Figure 3:
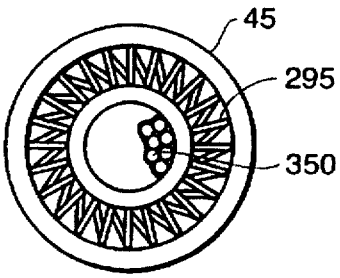
FIG. 3 is a partial cross sectional view of the invention, taken generally along lines 3—3 of FIG. 2, illustrating a second urging means for urging a collar towards a neutral collar position.

A rotatable collar 45 is annularly affixed on the stick 10 such that the collar 45 may be manually rotated about the longitudinal axis 50 of the stick 10 in both clockwise and counterclockwise directions from a neutral collar position. Preferably, the apparatus includes a second urging means 295 for preferentially holding the collar 45 at the neutral collar position 60 and for urging the collar 45 back to the neutral position 60 when the collar 45 is not in the neutral position 60. The second urging means 295 may be two springs mounted in opposite arcs, each spring being mounted at one end to the collar 45 and at the other end to the stick 10 (FIG. 3), or other suitable urging means. Clockwise rotation of the collar 45 away from the neutral collar position 60 causes a third set of signals to be transmitted to the computer with the voltage being proportional to the magnitude of clockwise rotation or the collar away from the neutral collar position 60. Similarly, counterclockwise rotation of the collar 45 away from the neutral collar position 60 causes a fourth set of signals to be transmitted to the computer with the voltage being proportional to the magnitude of counterclockwise rotation or the collar away from the neutral collar position 60. Alternate embodiments of the invention cause the voltages of the third and fourth sets of signals to be non-linear with respect to the magnitude of rotation of the collar 45 away from the neutral collar position 60.

In an additional embodiment, the rotatable collar includes an electronic collar position sensor 130 (FIG. 4) which is included for sensing the position of the collar 45 and for producing an electrical voltage in proportion to the position of the collar 45. In one embodiment of the invention, the electronic collar position sensor 130 is a potentiometer transducer. Clearly, however, other types of position sensors 130 could be utilized, such as optical, magnetic, and the like, and one skilled in the art could readily choose other means of controlling video or computer functions through the electrical signals generated by the collar position sensor 130.

In still another embodiment, the first signal means 70 of the apparatus further includes a first electronic stick position sensor 180 for sensing the position of the stick 10 and for producing an electrical voltage in proportion to the position of the stick 10 (FIG. 2 and 4). Similarly, the second signal means 75 of the apparatus further includes a second electronic stick position sensor 230 for sensing the position of the stick 10 and for producing an electrical voltage in proportion to the position of the stick 10. In one embodiment of the invention, the first and second electronic stick position sensors 180 and 230 are potentiometer transducers. In a second embodiment, the operation of the first and second electronic stick position sensors 180 and 230 are combined in a single potentiometer transducer. Referring now to the embodiment shown in FIG. 2, the first and second electronic stick position sensors 180, 230 are round potentiometer transducers. In the embodiment of FIGS. 4 and 5, the first and second electronic stick position sensors 180, 230 are linear potentiometer transducers, such that a wiper 185 is fixedly attached to the corner assembly 310 with a screw means 186. As such, linear displacement of the carrier assembly 310 causes a proportional linear displacement of the wiper 185 within the position sensors 180, 230, resulting in an electrical resistance proportional to the position of the stick 10. Clearly, alternate types of electronic position sensor 180, 180, 230, 230 could be utilized, such as optical, magnetic, and the like. Moreover, alternate first signal means 70 and second signal means 75 could also be devised without significantly deviating from the spirit and scope of the present invention.

A console 80 may be optionally mounted on the upper end 90 of the stick 10 (FIGS. 1 and 2). The console has a control panel 100 with a plurality of control means 110 for finger actuation so that a single hand can provide manual control of the stick 10, the collar 45 and the control panel 100. The control means 110 may include buttons, switches or rotary knobs capable of manipulation with a single finger. As would be understood by those in the art, these control means may accomplish any number of computer functions. Further, status indicators 120 may be further included on the console 80 for providing status of computer functions. Preferably, such status indicators 120 are positioned such that they are not blocked by a person's hand or arm while the person is grasping the control stick 10.

While the invention has been described with reference to several preferred embodiments, it is to be clearly understood by those skilled in the art that the invention is not limited thereto. For example, other video or computer functions might be controlled through the present invention, such as video games, computer numeric control (CNC) manufacturing equipment, computer mapping, computerized or video information display, computerized communications, and the like. Thus, the scope of the invention is to be interpreted only in conjunction with the appended claims.

I claim:

1. An ergonomic control apparatus for controlling video and computer functions including a control stick and a rotatable collar annularly disposed on the exterior of said control stick, said control stick including a neutral stick position defined by a substantially vertical axis, wherein the improvement comprises:

a) a first signal means being connected to said control stick such that movement of said control stick forward from said neutral stick position causes said first signal means to transmit a first set of signals to a computer;

b) a second signal means being connected to said control stick such that movement of said control stick rearward from said neutral stick position causes said second signal means to transmit a second set of signals to a computer; and c) said rotatable collar being configured such that rotation of said collar about said vertical axis in the clockwise direction transmits a third set of signals to a computer or the like, said collar being further configured such that rotation of said collar about said vertical axis in the counterclockwise direction transmits a fourth set of signals to a computer.

2. The ergonomic control apparatus for controlling video and computer functions of claim 1 further including a console mounted on the upper end of the stick, said console having a control panel with one or more control means for finger actuation so that one hand can provide manual control of the stick, the rotatable collar and the control panel.

3. The ergonomic control apparatus for controlling video and computer functions of claim 1 further including a console mounted on the upper end of the stick, said console having a control panel with one or more status indicators.

4. The ergonomic control apparatus for controlling video and computer functions of claim 1 wherein:

said first signal means produces an electrical voltage in proportion to the forward movement of said control stick; and said second signal means produces an electrical voltage in proportion to the rearward movement of said control stick.

5. The ergonomic control apparatus for controlling video and computer functions of claim 1 wherein:

said rotatable collar produces an electrical voltage in proportion to the rotation of said rotatable collar around said control stick.

* * * * *